US009615658B1

(12) United States Patent
Nobles et al.

(10) Patent No.: US 9,615,658 B1
(45) Date of Patent: Apr. 11, 2017

(54) DESK WITH A PROJECTILE RESISTANT DESKTOP

(71) Applicants: Donald Ray Nobles, Gallatin, TN (US); Alexander Ryan Nobles, Jr., West Jordan, UT (US)

(72) Inventors: Donald Ray Nobles, Gallatin, TN (US); Alexander Ryan Nobles, Jr., West Jordan, UT (US)

( * ) Notice: Subject to any disclaimer, the term of this patent is extended or adjusted under 35 U.S.C. 154(b) by 0 days.

(21) Appl. No.: 14/589,857

(22) Filed: Jan. 5, 2015

(51) Int. Cl.

| | |
|---|---|
| ***A47B 39/00*** | (2006.01) |
| ***A47B 39/02*** | (2006.01) |
| ***A47B 13/08*** | (2006.01) |
| ***A47B 13/00*** | (2006.01) |
| ***A47B 41/02*** | (2006.01) |
| ***F41H 5/00*** | (2006.01) |

(52) U.S. Cl.
CPC ..... *A47B 39/02* (2013.01); *A47B 13/003* (2013.01); *A47B 13/08* (2013.01); *A47B 41/02* (2013.01); *F41H 5/00* (2013.01)

(58) Field of Classification Search
CPC .... A47B 2200/0072; A47B 2200/0096; A47B 2200/13; A47B 39/00; A47B 39/02; A47B 13/003; A47B 13/08; A47B 41/02
USPC ..... 297/174 R, 135; 312/235.9; 108/157.1, 108/159
See application file for complete search history.

(56) References Cited

U.S. PATENT DOCUMENTS

| | | | | | |
|---|---|---|---|---|---|
| 340,341 | A * | 4/1886 | Mauchain | A47C 3/26 | 248/423 |
| 541,982 | A * | 7/1895 | Nelon | A47B 39/00 | 297/174 R |
| 1,195,627 | A * | 8/1916 | Thum | A47B 39/00 | 297/172 |
| 2,168,910 | A * | 8/1939 | Merrill | A47B 39/02 | 297/172 |
| 2,579,606 | A * | 12/1951 | Oom | A47B 39/02 | 16/333 |
| 2,624,392 | A * | 1/1953 | Bargen | A47B 41/02 | 297/174 R |
| 2,673,595 | A * | 3/1954 | Kump, Jr. | A47B 39/04 | 297/172 |
| 2,778,706 | A * | 1/1957 | Macwhirter | A47B 39/02 | 312/316 |

(Continued)

OTHER PUBLICATIONS

Detachable Hinge for Furniture http://www.alibaba.com/product-gs/557391257/Detachable_hinge_for_furniture.html.

(Continued)

*Primary Examiner* — Jose V Chen
(74) *Attorney, Agent, or Firm* — Jones Waldo Holbrook & McDonough, PC; Brent T. Winder

(57) ABSTRACT

A projectile resistant desk. The desk includes a desktop support having a receptacle and a removable desktop hingedly coupled to a slip rod; wherein the slip rod substantially corresponds to the receptacle and allows the desktop to be removably secured to the desktop support. The projectile resistant desk is suited for frame styled or storage styled supports. The desktop can be made of a variety of materials including bullet-resistant glass, polycarbonates, polyurethane, fiberglass and resins and can include one or more handles on its underside. The desk can further include a projectile resistant leg shield.

15 Claims, 12 Drawing Sheets

(56) References Cited

U.S. PATENT DOCUMENTS

| | | | | | |
|---|---|---|---|---|---|
| 3,622,199 | A * | 11/1971 | Ho | A47B 41/02 | 108/138 |
| 4,238,097 | A * | 12/1980 | Clausen | A47B 19/06 | 248/188.7 |
| 5,054,852 | A * | 10/1991 | Tholkes | A47B 83/02 | 297/172 |
| 5,547,270 | A * | 8/1996 | Dang | A47B 39/00 | 297/140 |
| 5,554,816 | A | 9/1996 | Skaggs et al. | | |
| 6,170,379 | B1 | 1/2001 | Taylor | | |
| 6,622,607 | B1 | 9/2003 | Miller | | |
| 7,146,899 | B2 | 12/2006 | Imblum et al. | | |
| 7,314,248 | B2 * | 1/2008 | Mabon | A47B 9/08 | 297/118 |
| 7,934,444 | B2 | 5/2011 | Carberry et al. | | |
| 8,069,769 | B2 | 12/2011 | Carberry et al. | | |
| 8,234,967 | B2 | 8/2012 | Carberry et al. | | |
| 9,254,037 | B2 * | 2/2016 | Benden | A47B 39/00 | |
| 2012/0090452 | A1 | 4/2012 | Sudhakar | | |
| 2012/0152096 | A1 | 6/2012 | Peters | | |
| 2014/0123882 | A1 * | 5/2014 | Kassanoff | A47B 87/002 | 108/26 |

OTHER PUBLICATIONS

Detachable hinge with different size for your choice http://www.alibaba.com/product-gs/426452539/detachable_hinge_with_different_size_for_h . . . .

* cited by examiner

DESK WITH A PROJECTILE RESISTANT DESKTOP

BACKGROUND

In recent years there have been increasingly numerous reports of shootings at schools at all levels with tragic consequences. In response to concerns over school safety, a variety of possible solutions have been proposed and implemented—from arming teachers and increasing police or security presence at schools to locking school doors during hours of operation and strengthening visitor management programs. Each of these solutions—while improving the overall safety of the school environment—cannot fully prevent hostile intrusion. Thus an added level of protection for students and faculty against armed school intrusion would be desirable.

The present invention in its various embodiments is a desk with a projectile resistant desktop. The desktop is constructed such that it can provide all traditional desktop functions; but has the added advantage of being made of a projectile resistant material. Projectile in the present case typically means bullets; but is not intended to be limited to just bullets. Rather, the term as used herein would also include any life-threatening or hazardous objects from which a student might need to be shielded such as knives, arrows, etc. The desktop can include a hinged slip rod mechanism that allows the desktop to be raised while remaining connected to the desk frame (or storage space depending on the style of desk). In this manner, the desktop provides concealment thus making it more difficult for an armed intruder to take aim. In the event a bullet or other projectile is fired, the desktop would also serve as a shield against such projectiles. The slip rod mechanism allows the desktop to be entirely removed for greater mobility as needed. As illustrated herein, in certain embodiments, the desk can be further equipped with a leg shield feature thus providing substantially full body protection.

Thus, even if an armed intruder is able to get into a school, the present invention in its various embodiments provides an added level of protection for students and faculty. The slip rod mechanism also allows for much quicker release in the event of an intruder—where seconds can mean the difference between life and death—and can be operated by the youngest elementary school student. The hinged connection also allows for adaptability depending on the circumstances. For example, should an intruder alert be sounded, students can raise the desktop on its hinges initially and hunker down. Then, if mobility is needed, a simple upward lifting will disengage the desktop and allow it to be carried, while providing shielding protection, to a different location.

The slip rod feature allows for easy removal; but at the same time provides a snug fit thus not interfering with the operability of the desk or creating a wobbly surface. It also accommodates a wide variety of desk styles. Key features of the invention can also be retrofitted to existing desks thus providing the additional protection while keeping implementation expenses to a minimum.

The foregoing advantages among others are provided by the present invention in its various embodiments.

SUMMARY OF THE INVENTION

The present invention in its various embodiments is a projectile resistant desk. The desk in its various embodiments includes a desktop support having a receptacle and a removable desktop hingedly coupled to a slip rod. The slip rod substantially corresponds to the receptacle and allows the desktop to be removably secured to the desktop support. The desktop support can be a frame styled support or a storage styled support. The desktop can be made of a variety of known projectile resistant materials alone or in combination including, but not limited to, bullet-resistant glass, polycarbonates (including specialized scratch resistant polycarbonates), polyurethane, fiberglass and resins. They can also be conventional desktop materials equipped with protective interlayers and protective films. The desk can include one or more handles on its underside as well as an integrated chair. In certain embodiments, a leg shield can also be included. Multiple hinged couplings and corresponding receptacles can be utilized depending on circumstances. The desk can also include a mounting bracket.

DETAILED DESCRIPTION OF THE ILLUSTRATED EMBODIMENTS

Figure 1:
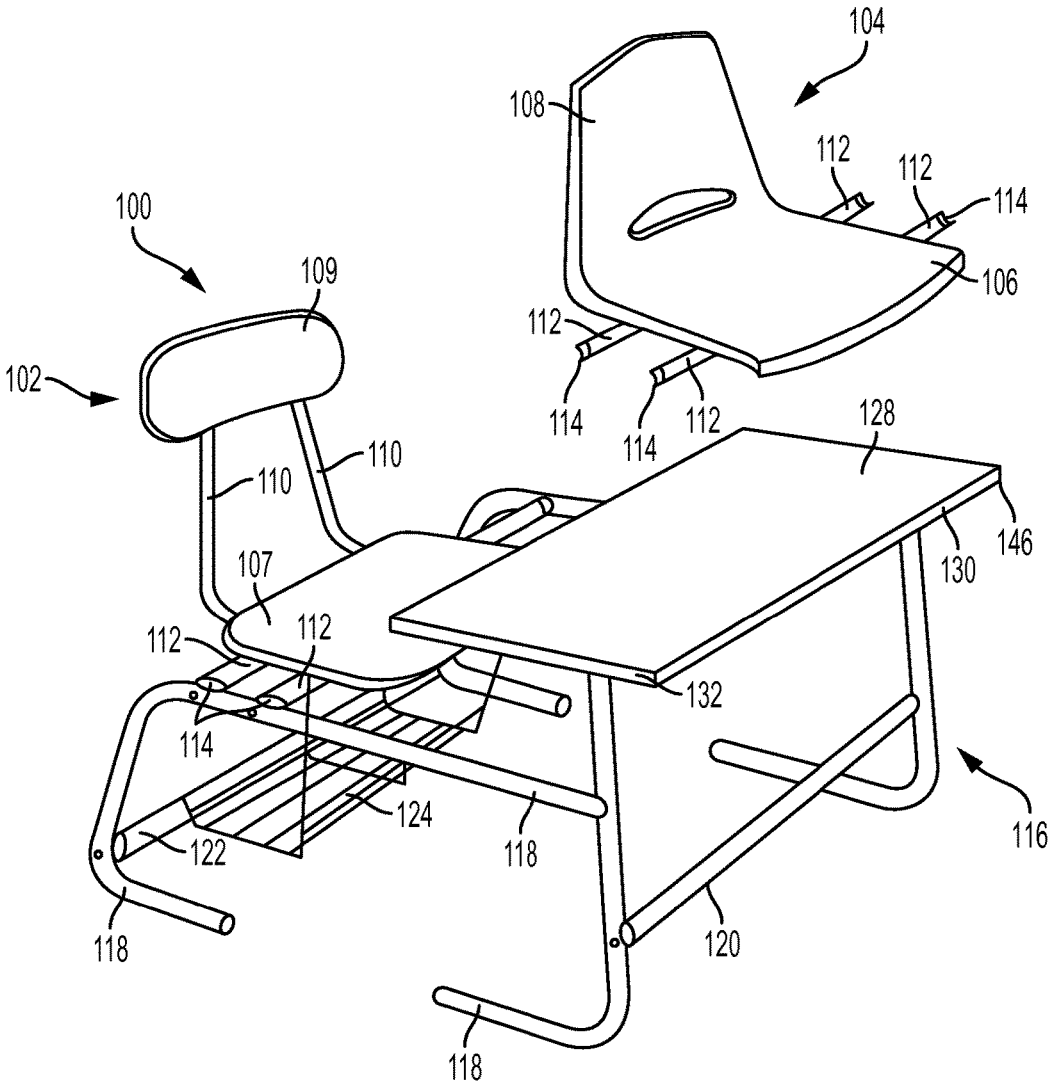
FIG. 1 shows a side perspective view of a projectile resistant desk according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring now to FIG. 1, a side perspective view of a projectile resistant desk 100 is shown according to one embodiment of the present invention. The desk 100 includes a chair 102 made of a seat section 107 connected to a backrest section 109 with frame elements 110. The chair 102 is connected to a larger frame assembly 116 with mounting members 112. In this embodiment, the mounting members 112 further include cap assemblies 114 at their ends to allow for a more snug fit with the frame assembly 116.

The frame assembly 116 in this embodiment includes side frame members 118, front frame members 210 and rear frame members 122. The frame assembly 116 is typically constructed of steel and/or steel tubing; but could be made of numerous materials including, but not limited to, steel, wood and plastic alone or in combination. In this embodiment, the frame assembly 116 further includes a book rack 124.

This particular frame assembly 116 lends itself well to the present invention as it allows for an appropriate desktop connection as well as the inclusion of the front leg shield 170 (FIG. 10) as discussed further below. However, other configurations may be desirable depending on the circumstances and are considered to be within the scope of the present invention. By way of illustration only, side frame members 118 in FIG. 1 are shown as having bent legs to provide for increased stability. In certain embodiments, it may be desirable to remove such bends and have substantially straight legs. Desk 100 further includes a removable desktop 146. The top surface 128, front edge 130 and side edge are visible in this figure.

FIG. 1 also illustrates a different chair embodiment that can be utilized in connection with the present invention. This particular chair 104 is a single molded style having a seat section 106 and a backrest section 108. Numerous other chair configurations as would be apparent to one skilled in the art would similarly be suitable for use with the present invention. It is also noted that, in some embodiments, the chair would not be an integrated part of the desk; but would instead be a separate piece of furniture.

Figure 2:
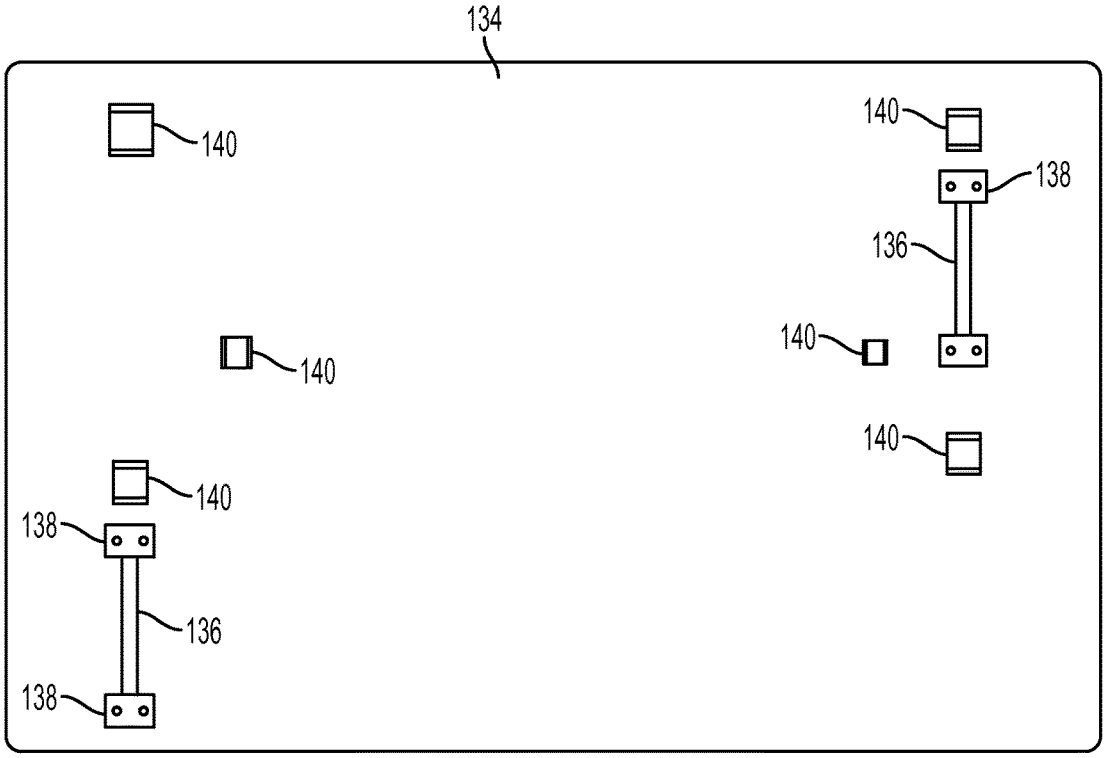
FIG. 2 depicts the underside of desktop with removable mechanism according to one embodiment of present invention.

FIG. 2 depicts the underside of a desktop 134 with removal mechanism according to one embodiment of present invention. This particular desktop removal mechanism utilizes clips 140 that engage with the frame assembly 116 and allow for quick release of the desktop as needed. In particular, the clips 140 substantially conform to the frame assembly 116; such that they form a tight friction fit. In this embodiment, the clips 140 are quick release mounting clips.

In the illustrated embodiment, there are two handles 136 that can be grasped by a user when removal and shielding is desired. The handles 136 are secured to the underside of desktop 134 with connectors 138. In this embodiment, the connectors 138 are brackets secured to the underside 134 with screws or similar fasteners. It is noted that, while six clips 140 are shown in this figure, in other circumstances, it may be desirable to have more clips or fewer clips. Similarly, more or fewer handles 136 may be desirable depending on the circumstances.

Figure 3:
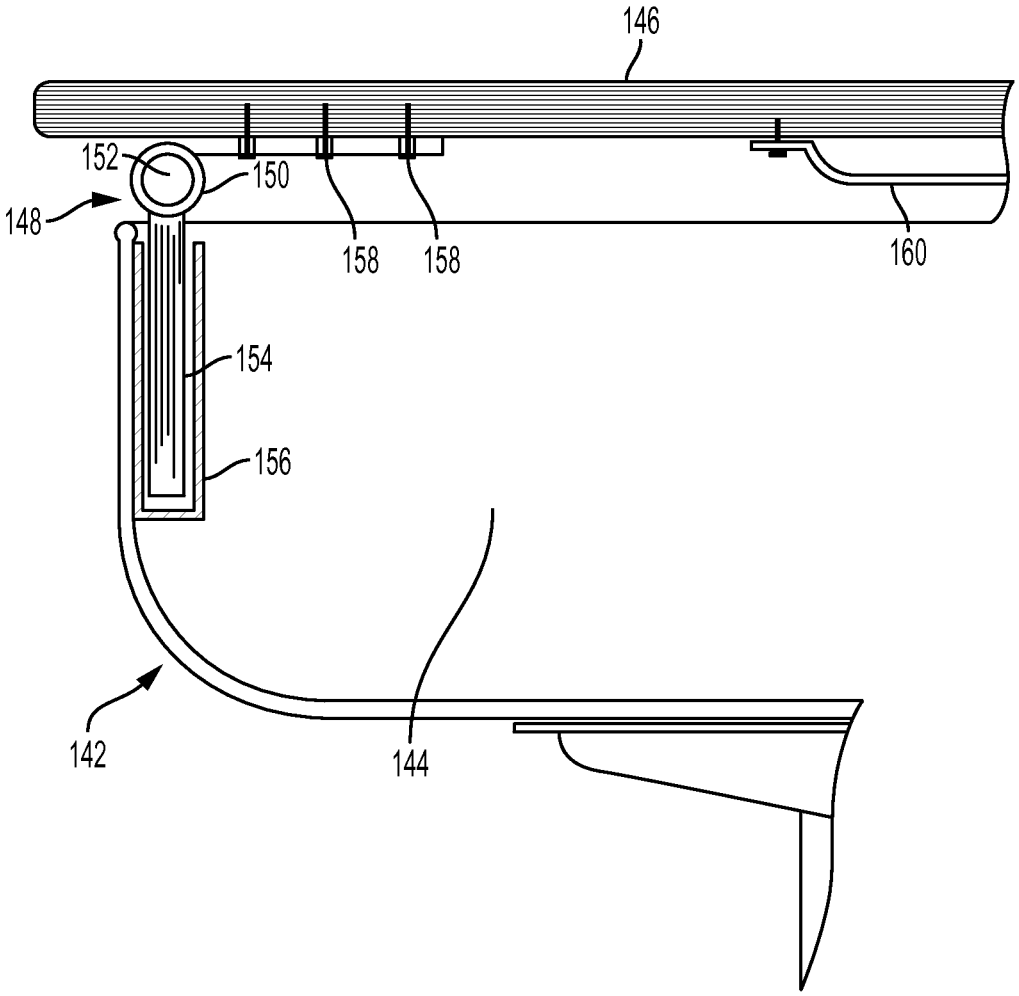
FIG. 3 is a side sectional view of a storage style desk with removable hinged slip rod desktop according to one embodiment of present invention.

FIG. 3 is a side sectional view of a storage style desk 142 with a removable desktop according to one embodiment of present invention. As is characteristic of a storage style desk 142, the desktop 146 partly defines a storage space 144 in which a user would typically put school supplies. The desktop 146 is attached with a hinged slip rod mechanism 148 comprising a hinge 150, a hinge pin 152 and a slip rod 154 that corresponds to receptacle 156. In this embodiment, the receptacle 156 is secured to the desk on the inside of the storage space 144. However, in certain embodiments, it may be desirable to have the receptacle 156 be on the outside of the desk. Receptacle 156 can be secured to desk with numerous connection mechanisms known in the art including but not limited to welding, adhesives and hardware fasteners.

In operation, the slip rod 154 would insert into receptacle 156 when the desk is in use. In this and other embodiments illustrated herein, the slip rod 154 is shown approximately corresponding to the depth of the receptacle 156. However, in other embodiments, the rod 154 could be substantially shorter than the depth of the receptacle 156. In other embodiments, the receptacle 156 could be open on the bottom and the length of slip rod 154 could exceed the depth of the receptacle 156. It is further noted that use of the term "rod" is not intended to be limited to a cylindrical or any particular shape. Rather the term rod as used herein includes numerous cross-sectional shapes including, but not limited to, substantially round; substantially square; substantially polygonal; and substantially rectangular or combinations thereof. When inserted into receptacle 156, rod fits snugly enough that the desktop 146 does not wobble.

Hinge leaf 151 (FIG. 5) is secured to the underside of the desktop 146 with one or more connectors 158 which in this illustration are one or more screws. The desktop 146 can also include one or more handles 160 by which the desktop 146 can be raised or, as needed, removed.

In operation, a user would, in an intrusion scenario, raise the desktop 146 to serve as a shield and form of concealment. In raising the desktop 146, hinge 150 would pivot around hinge pin 152 thus allowing the desktop 146 to be raised at one end and secured to the desk at the opposite end. Should the need arise, a user could then either grab the handle 160 or, if necessary, the edges of the desktop 146 or both and by lifting pull rod 154 out of receptacle 156 thus freeing the desktop 146 for use as a more mobile shield.

The hinged slip rod mechanism 148 could be made of numerous materials including, but not limited to steel or plastic and combinations thereof. In certain embodiments, steel and plastic tubing is preferred. The desktop 146 could likewise be made of a variety of known projectile resistant materials alone or in combination including, but not limited to, bullet-resistant glass, polycarbonates (including specialized scratch resistant polycarbonates), polyurethane, fiberglass and resins. It can also be conventional desktop materials equipped with protective interlayers and protective films.

Figure 4:
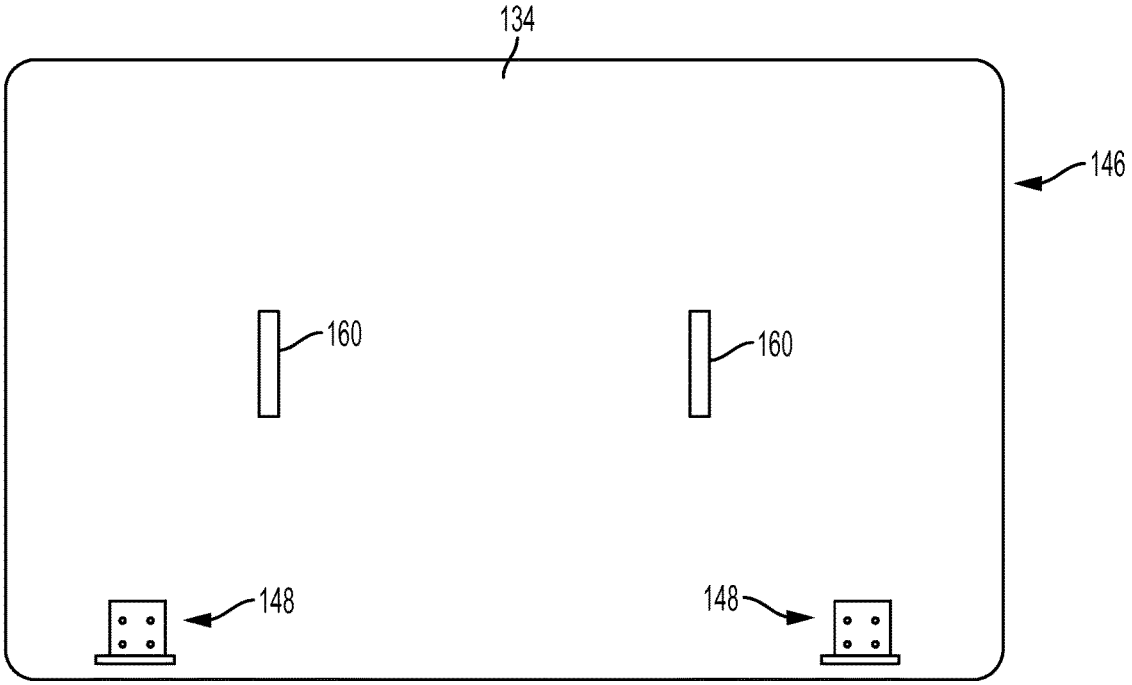
FIG. 4 illustrates the underside view of a removable hinged slip rod desktop according to one embodiment of present invention.

Referring now to FIG. 4, an underside 134 view of a removable hinged slip rod desktop 146 is shown according to one embodiment of present invention. This desktop 146 includes two handles 160 and two hinged slip rod mechanisms 148. It is noted that, while two hinged slip rod mechanisms 148 would be most typical, in other embodiments it may be desirable to have more or fewer such mechanisms. It is also noted that, depending on the circumstances, fewer or more handles 160 may be desirable. In some instances, there may be no handles 160.

Figure 5:
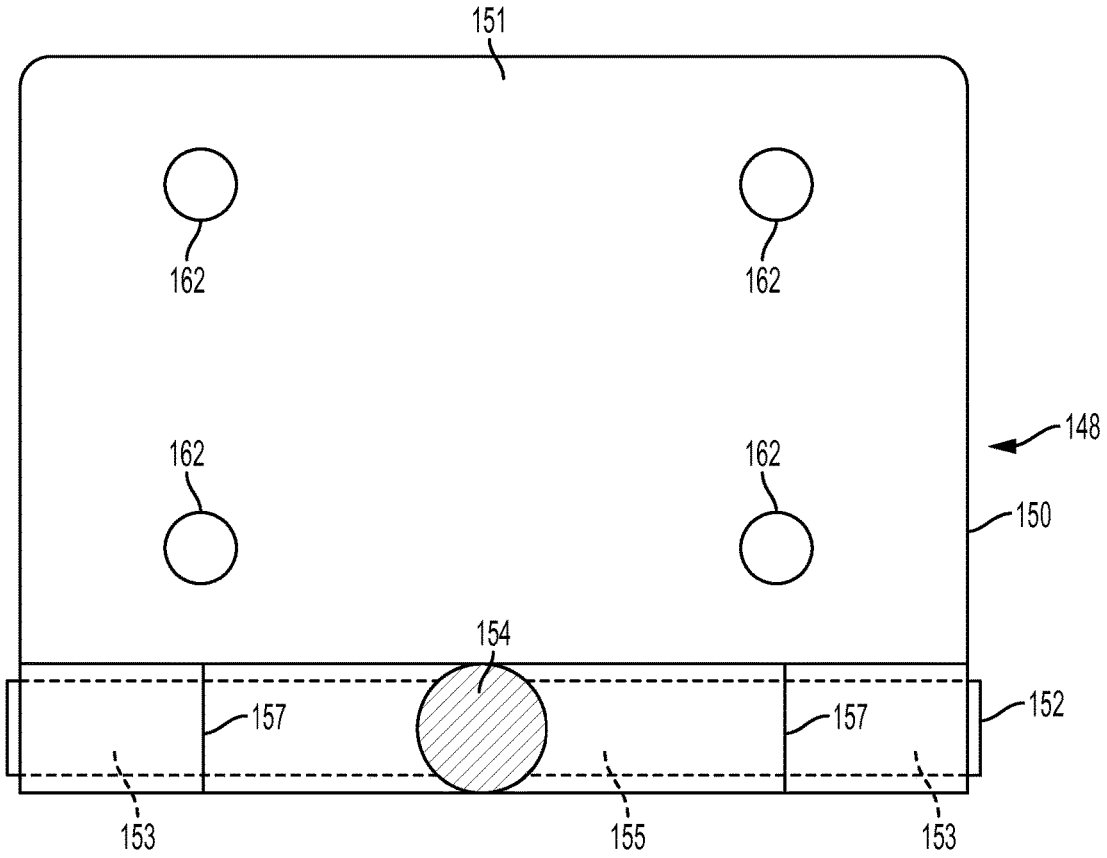
FIG. 5 illustrates a front close up view of a hinge slip rod mechanism.
Figure 6:
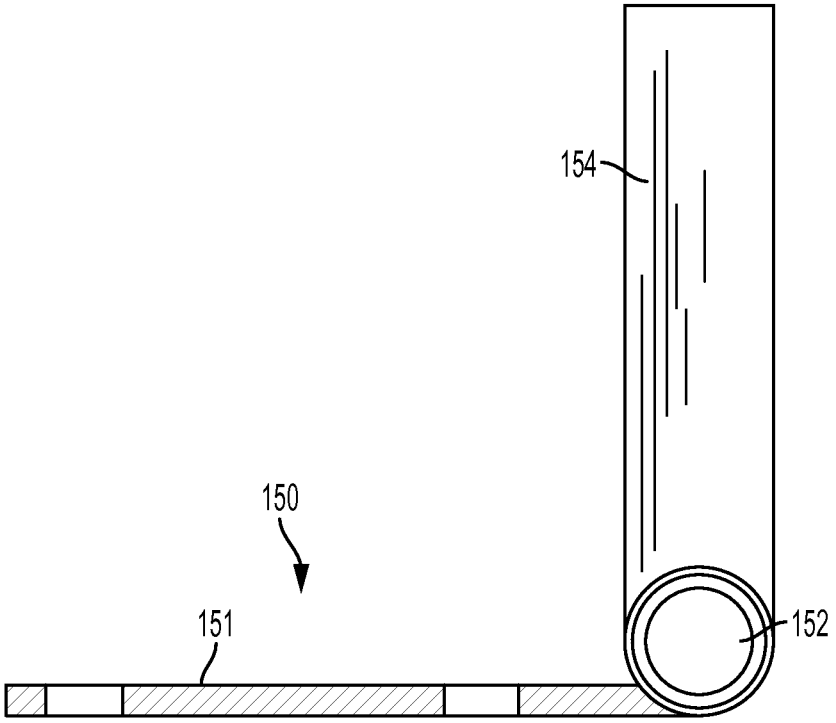
FIG. 6 illustrates a side close up view of a hinge slip rod mechanism.

FIGS. 5 and 6 illustrate closer views of hinge slip rod mechanisms 148 according to one embodiment of the present invention. The mechanism 148 includes a hinge 150 having a hinge leaf 151, a hinge pin 152. Slip rod 154 is positioned approximately in the center of hinge 150, though in other embodiments, the relative placement of the slip rod 154 can vary depending on circumstances. As is typical of hinges generally, a portion 153 of the hinge would be immovably affixed to the leaf 151 with a weld, adhesive or other similar affixing mechanism as would be apparent to one skilled in the art. Section 155 of hinge is similarly immovably affixed to slip rod 154. Breaks 157 allow leaf 151 to be pivotally raised around pin 152 while rod 154 remains substantially in place.

Holes 162 allow leaf 151 to be secured to the underside 134 of desktop 146. Leaf 151 can be secured with a variety of connection mechanisms that would be apparent to one skilled in the art including but not limited to screws, nails and adhesives. Advantageously, the hinge slip rod mechanism 148 can work for storage styled or frame styled desks. It is noted that some distinction is made between "storage styled" and "frame styled" desks as those terms are used herein. Generally speaking, the storage styled desk refers to a desk with a defined storage space under the desktop. However, such a distinction is not intended to exclude a storage styled desk from having a frame or frame features. Both desk types are considered suitable desktop supports for use with the present invention.

Figure 7:
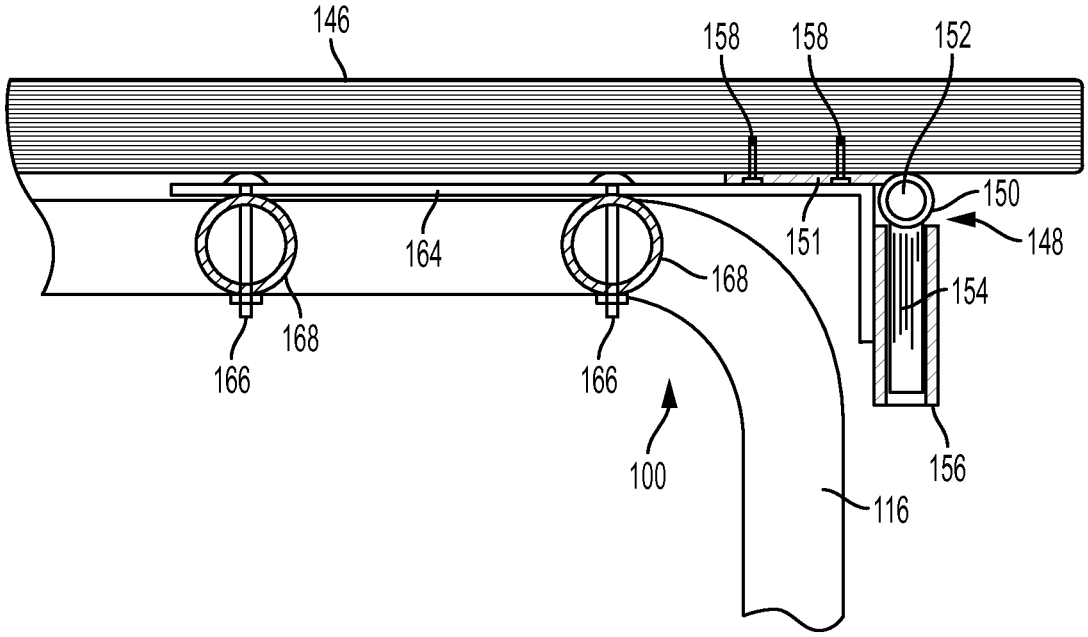
FIG. 7 is a side-sectional view of a frame style desk with removable hinged slip rod desktop according to one embodiment of present invention.

FIG. 7 is a side-sectional view of a frame style desk 100 with a removable desktop 146 according to one embodiment of present invention. The desktop 146 is secured to the frame 116 with a hinged slip rod mechanism 148 comprising a hinge 150, a hinge pin 152 a slip rod 154 and a receptacle 156 for the slip rod 154. In this embodiment, a mounting bracket 164 can be utilized to secure the receptacle 156 to the desk frame assembly 116. In the illustrated embodiment, bracket 164 is secured to cross members 168 of frame assembly 116 with connectors 166. In this embodiment, connectors 166 are bolts and nuts but could be numerous other connection mechanisms as would be apparent to one skilled in the art including but not limited to welding, screws, rivets and adhesives.

Receptacle 156 is secured to bracket 164 by welding; but numerous other known connection mechanisms as would be apparent to one skilled in the art could be used including but not limited to screws, rivets and adhesives.

Leaf 151 is secured to underside 134 of desktop 146 with connectors—which in this embodiment are screws. However, numerous other connection mechanisms would be apparent to one skilled in the art including, but not limited to, nails, nuts and bolts and adhesives.

Figure 8:
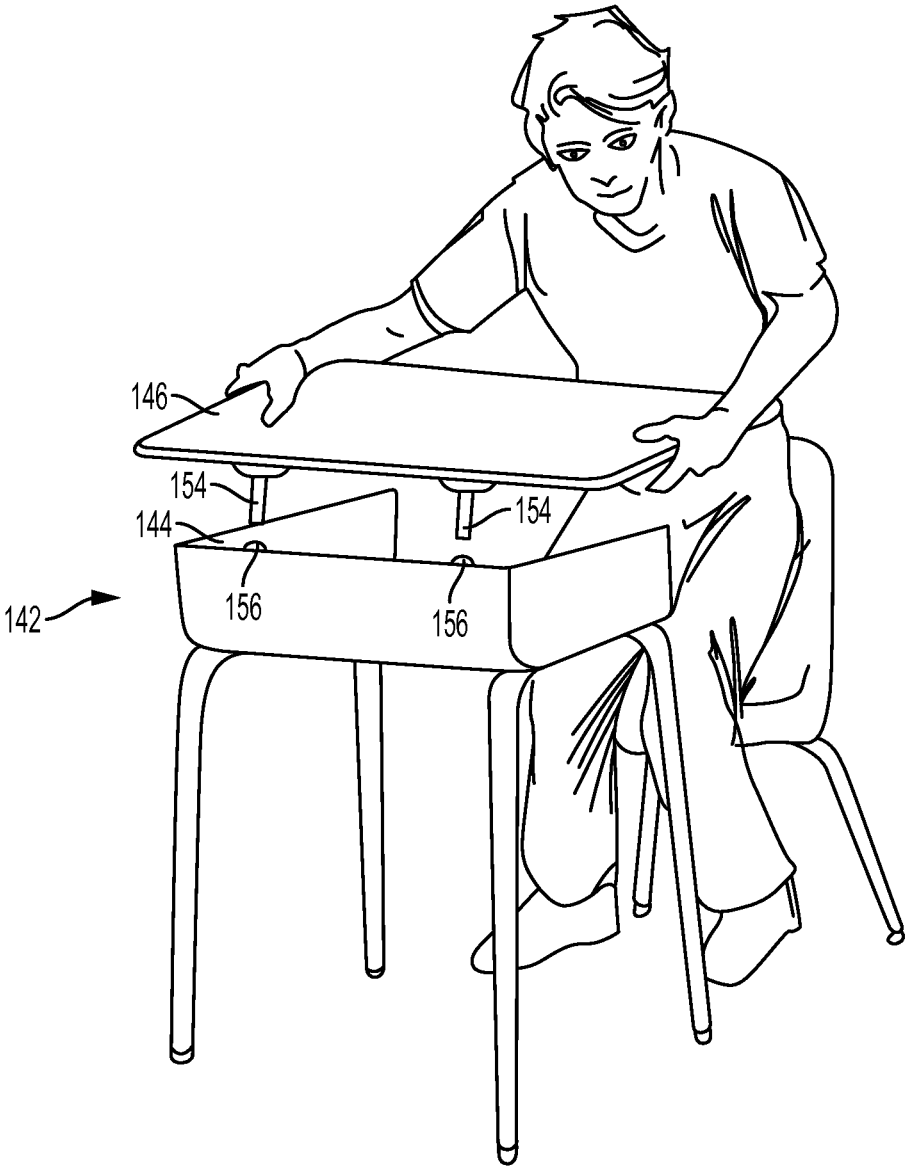
FIG. 8 is a depiction of a user removing a hinged slip rod desktop in a storage style desk.

FIG. 8 is a depiction of a user removing a hinged slip rod desktop in a storage style desk 142. The desk includes a storage space 144 and a removable desktop 146. As a user pulls upward on the desktop, slip rods 154 are drawn out of receptacles 156 thus freeing the desktop for use as a shield.

Figure 9:
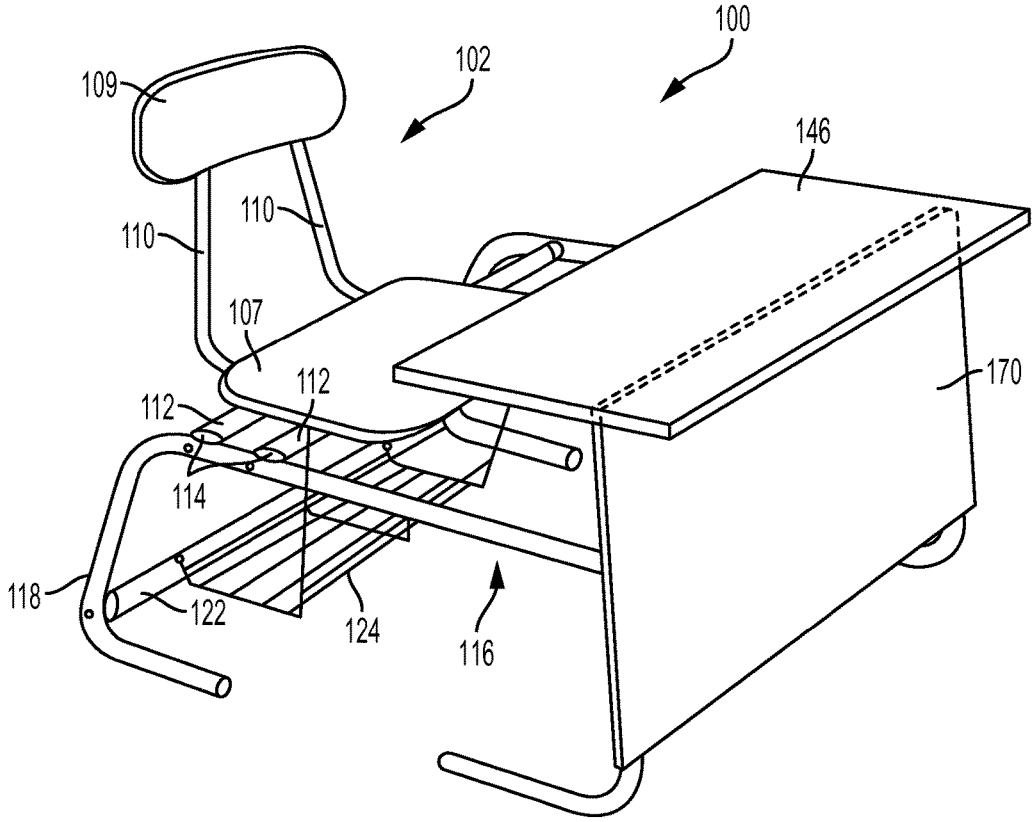
FIG. 9 is a side perspective view of a projectile resistant desk having a leg shield according to one embodiment of the present invention.
Figure 10:
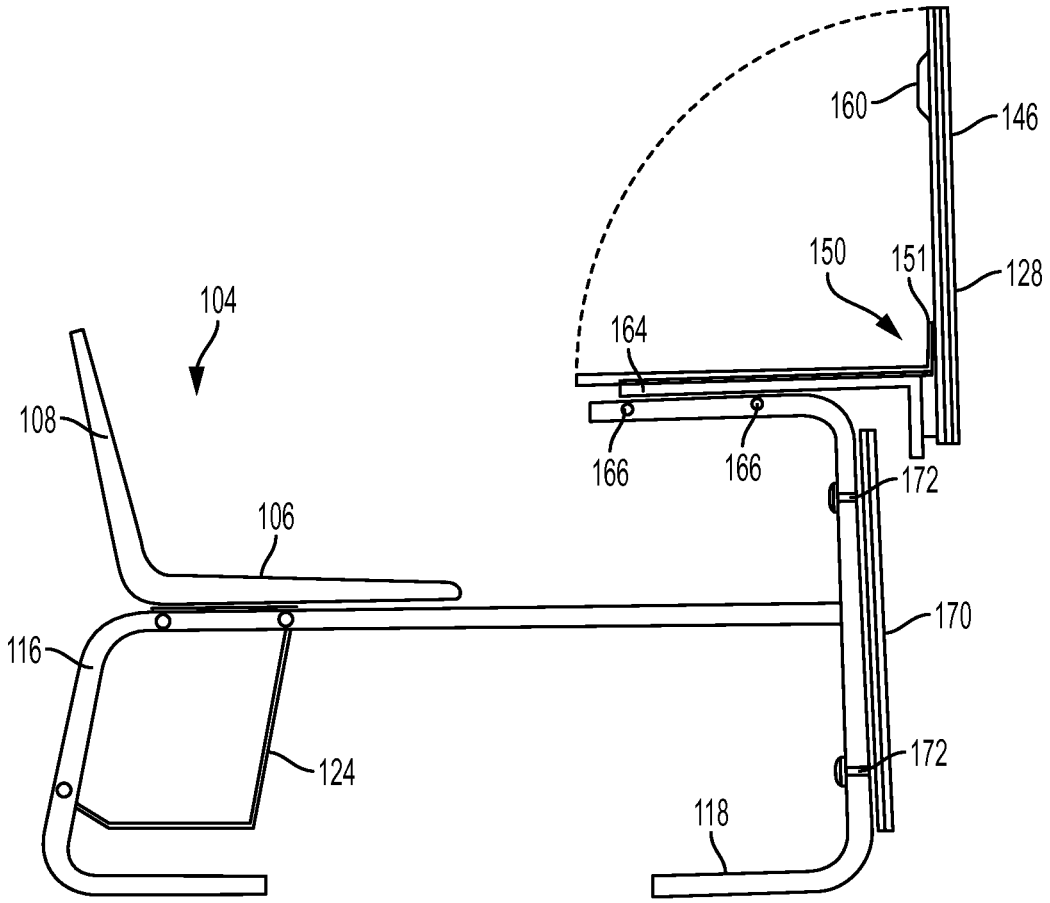
FIG. 10 is a side view of a frame style desk with a removable hinged slip rod desktop depicting a lowered to raised position according to one embodiment of the present invention.

FIGS. 9 and 10 illustrate a projectile resistant desk 100 having a leg shield 170 in combination with a removable projectile resistant desktop 146 according to one embodiment of the present invention. Front shield 170 is advantageous as it allows for both upper and lower shielding when the desktop 146 is raised. Front shield 170 can be made of a variety of known projectile resistant materials alone or in combination including, but not limited to, bullet-resistant glass, polycarbonates (including specialized scratch resistant polycarbonates), polyurethane, fiberglass and resins. It can also be made of conventional desktop materials equipped with protective interlayers and protective films.

In FIG. 10, front shield 170 is secured to side frame members 118 of frame assembly 116 by connectors 172. In this embodiment, connectors 172 are nuts and bolts. However, numerous other connection mechanisms as would be apparent to one skilled in the art would be suitable for this purpose including, but not limited to, screws, rivets, adhesives and welding. FIG. 10 also illustrates the hinging mechanism that allows a user to easily raise the desktop 146 as a shielding mechanism as needed.

Figure 11:
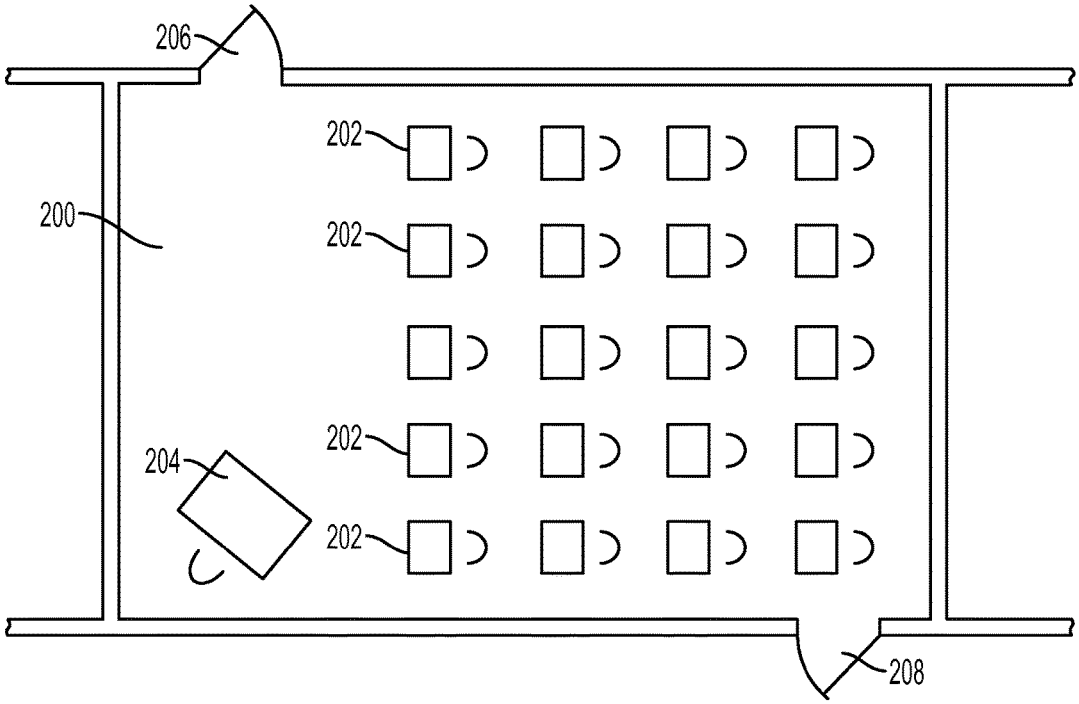
FIG. 11 depicts a standard classroom configuration.

The present invention also has specific utility in defensive positioning of desks in a classroom setting. In particular, FIG. 11 depicts a standard configuration of a classroom 200 with student desks 202 in a row by row arrangement facing the front of the classroom and the teacher desk 204. Doorway 206 illustrates a typical hallway door and doorway 208 an emergency door.

Figure 12:
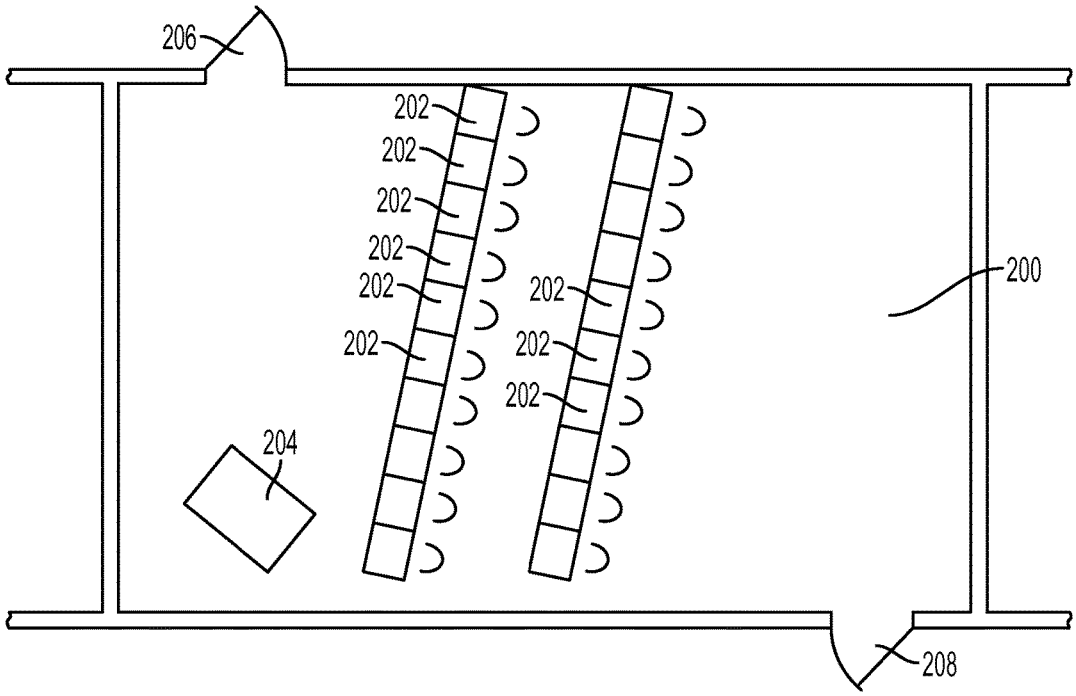
FIG. 12 depicts an example of an emergency desk configuration that can be quickly assembled in an emergency to maximize shielding effect.

In the event of an armed intrusion, the desks can quickly be positioned into a highly defensive position as depicted in FIG. 12. This configuration substantially directs the fronts of the student desks 202 toward the hallway door 206. This configuration directs maximum shielding toward the most likely entry point of an armed intruder and also allows for significant concealment as students seek to exit the emergency door 208.

Variations

It is understood that the above-described arrangements are only illustrative of the application of the basic principles of the present invention. Numerous modifications and alternative arrangements may be devised by those skilled in the art without departing from the spirit and scope of the present invention. The appended claims are intended to cover such modifications and arrangements.

For example, in one embodiment, the male and female orientation of the slip rod and receptacle can be reversed such that the receptacle is hingedly attached to the desktop and the rod is secured to the frame or storage style desktop support. The coupling remains essentially the same with rod inserting into the receptacle to provide a snug fit of the desktop on the frame.

What is claimed is:

1. A projectile resistant desk comprising:
   a) a desktop support wherein the desktop support has a back wall, two substantially opposing sidewalls and a bottom defining a storage space;
   b) a receptacle coupled to the back wall of the desktop support;
   c) a removable desktop configured to sit substantially atop the desktop support having a pivotal coupling and a slip rod having a first end and a second end; wherein the first end of the slip rod substantially corresponds to the receptacle and allows the desktop to be removably secured to the desktop support and the second end of the slip rod is secured to the pivotal coupling.

2. The projectile resistant desk of claim 1, wherein the desktop is made of one or more materials selected from the group consisting of bullet-resistant glass, polycarbonates, polyurethane, fiberglass and resins.

3. The projectile resistant desk of claim 1 further comprising one or more handles on an underside of the desktop.

4. The projectile resistant desk of claim 1 further comprising an integrated chair.

5. The projectile resistant desk of claim 1 further comprising a leg shield.

6. The projectile resistant desk of claim 1 wherein the removable desktop has one or more additional pivotal couplings and wherein the one or more additional pivotal couplings are secured to one or more additional slip rods.

7. The projectile resistant desk of claim 6 wherein the desktop support has one or more additional receptacles that correspond to the one or more additional slip rods.

8. The projectile resistant desk of claim 1 further comprising a mounting bracket.

9. A projectile resistant desk comprising:
   a) a desktop support wherein the desktop support has a back wall, two substantially opposing sidewalls and a bottom defining a storage space;
   b) a receptacle coupled to the back wall of the desktop support;

c) a removable desktop configured to sit substantially atop the desktop support having a pivotal coupling including a protrusion; wherein the protrusion substantially corresponds to the receptacle and allows the desktop to be removably secured to the desktop support.

10. The projectile resistant desk of claim 9, wherein the desktop is made of one or more materials selected from the group consisting of bullet-resistant glass, polycarbonates, polyurethane, fiberglass and resins.

11. The projectile resistant desk of claim 9 further comprising one or more handles on an underside of the desktop.

12. The projectile resistant desk of claim 9 further comprising a leg shield.

13. The projectile resistant desk of claim 9 wherein the removable desktop has one or more additional pivotal couplings and wherein the one or more additional pivotal couplings have one or more additional protrusions.

14. The projectile resistant desk of claim 13 wherein the desktop support has one or more additional receptacles that correspond to the one or more additional protrusions.

15. The projectile resistant desk of claim 9 wherein the protrusion is a rod.

* * * * *